United States Patent [19]

Chatham

[11] 4,190,157

[45] Feb. 26, 1980

[54] PHONOGRAPH COVER HOLDER (COVER-UP)

[76] Inventor: Mark S. Chatham, P.O. Box 14153, Milwaukee, Wis. 53214

[21] Appl. No.: 958,047

[22] Filed: Nov. 6, 1978

[51] Int. Cl.[2] ..... A47G 1/16

[52] U.S. Cl. ..... 206/477; 248/475 R

[58] Field of Search ..... 206/477; 248/205 A, 248/475 R, 466, 467, 488

[56] References Cited

U.S. PATENT DOCUMENTS

| | | | |
|---|---|---|---|
| 3,049,323 | 8/1962 | Peterlia | 248/488 |
| 3,300,173 | 1/1967 | Kennedy | 248/467 |
| 3,477,680 | 11/1969 | Fliger | 248/205 R |

FOREIGN PATENT DOCUMENTS

| | | | |
|---|---|---|---|
| 159046 | 9/1954 | Australia | 248/206 R |
| 1185830 | 2/1959 | France | 248/475 R |
| 421078 | 12/1934 | United Kingdom | 248/475 R |

*Primary Examiner*—Herbert F. Ross

[57] ABSTRACT

A device that can be adhered to a room wall, and which supports a corner of a phonograph record cover for the purpose of display; the device including a stationary base with adhesive on its rear, and a circular disc rotatable on its front, the disc having a notch to allow insertion of a corner of the cover therebehind, for resting on the base.

3 Claims, 9 Drawing Figures

PHONOGRAPH COVER HOLDER (COVER-UP)

This invention relates generally to wall display supporting holders.

A principal object pf the present invention is to provide a holder for supporting phonograph record covers on a room wall, so that they may be displayed like pictures, or posters; it being noted that many such covers are attractively colored and designed.

Another object is to provide a phonograph record holder, which will allow a user to remove the cover, and/or replace it, without damage to the cover, or to the wall.

Still another object is to provide a phonograph record holder, which allows covers to be arranged side by side, so as to share the same holder at each corner, in order that a collection of displayed covers makes an impressive sight; and which, by rearranging cover positions, or changing covers, gives variety to the display.

Other objects are to provide a phonograph record holder, which is simple in design, inexpensive to manufacture, rugged in construction, easy to use and efficient in operation.

These, and other objects, will be readily evident, upon a study of the following specfication, and the accompanying drawing, wherein.

Figure 2:
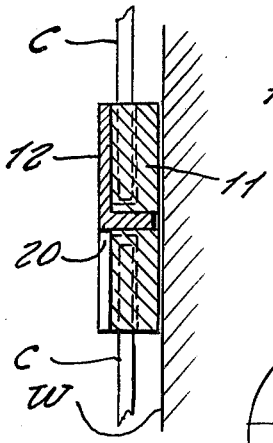
FIG. 2 is an enlarged cross-sectional view of one of the holders, taken on line 2—2 of FIG. 1.
Figure 4:
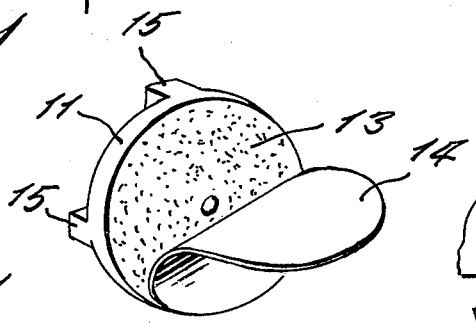
FIG. 4 is a rear view of the base component, with a protective paper being removed therefrom, so as to expose adhesive for mounting to a wall.
Figure 5:
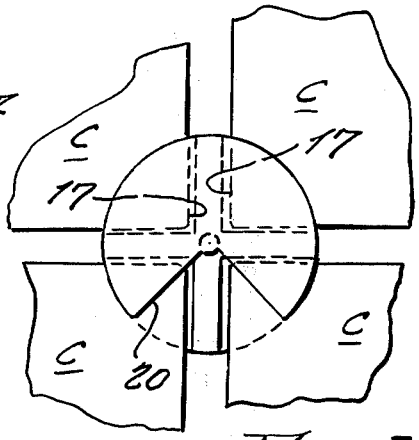
FIG. 5 is an enlarged front view of one of the holders, shown in FIG. 1
Figure 7:
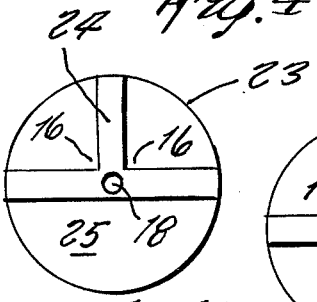
Figure 8:
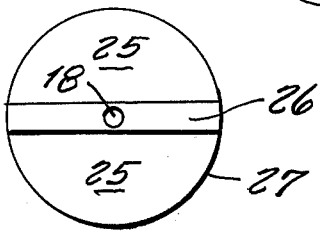
Figure 9:
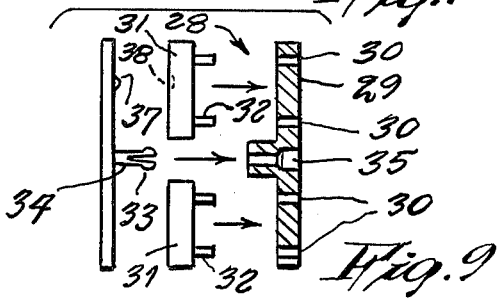
Figure 6:
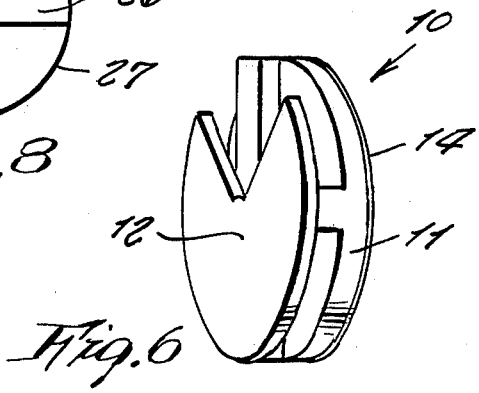
FIG. 6 is an assembly of the holder as retailed, with protective paper on the rear adhesive.

FIGS. 7 and 8 are front views of alternate designs of base components, for holding one or two double albums, and FIG. 9 is a cross-sectional view, similar to FIG. 2, and showing a modified construction, in which an enlarged rounded end, on the front cover post, allows it to snap in the base hole, so as not to fall out when rotated, the device also shown including a detent, and removable partitions, so as to convert to one or two double albums.

Referring now to the drawing in greater detail, and more particularly, to FIGS. 1 through 6 thereof at this time, the reference numeral 10 represents a phonograph record cover holder, according to the present invention, and which serves to support phonograph record covers C upon a room wall W.

The holder consists of a base 11 and a disc 12, both of which are molded of a hard plastic, so as to be low in cost to manufacture, easy to keep clean, and which can be made in many attractive colors.

The base can be circular, and has pressure-sensitive adhesive 13 applied to its rear side, so as to adhere to the wall. It is sold with a protective high gloss paper 14, that covers the adhesive, and which is peeled off when the base is intended to be stationarily mounted on the wall. Crossing ribs 15, at right angles to each other, protrude forwardly on a front side of the base, so as to form four square inside corners 16, into each of which a square corner 17, of a record cover, can be seated. A central hole 18, through the base, serves to support the disc in front of the base.

Figure 3:
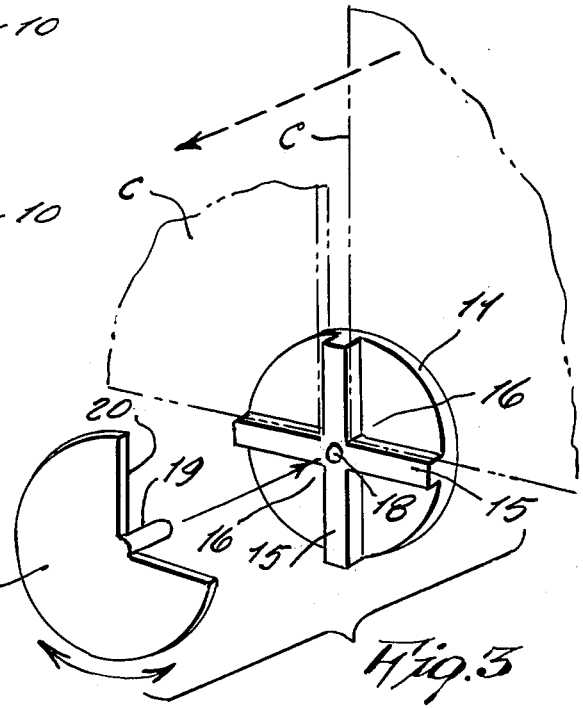
FIG. 3 is a perspective view of the invention components, shown separated.

The disc is likewise circular in shape, and includes a rearward extending stem 19, on its rear side, for fitting inside the hole 18. The disc rear side rests against the front side of the ribs. A right angle notch 20, on the periphery of the disc, extends a full one-quarter of the disc, so as to allow the cover corner 17 to pass therethrough, and into the space formed by the inside corner 16, as shown in FIG. 3. In order to lock the cover corner inside the space, the disc is then rotated approximately forty-five degrees to the position shown in FIG.5, thus disaligning the notch with the cover corner, and preventing it from falling out.

Figure 1:
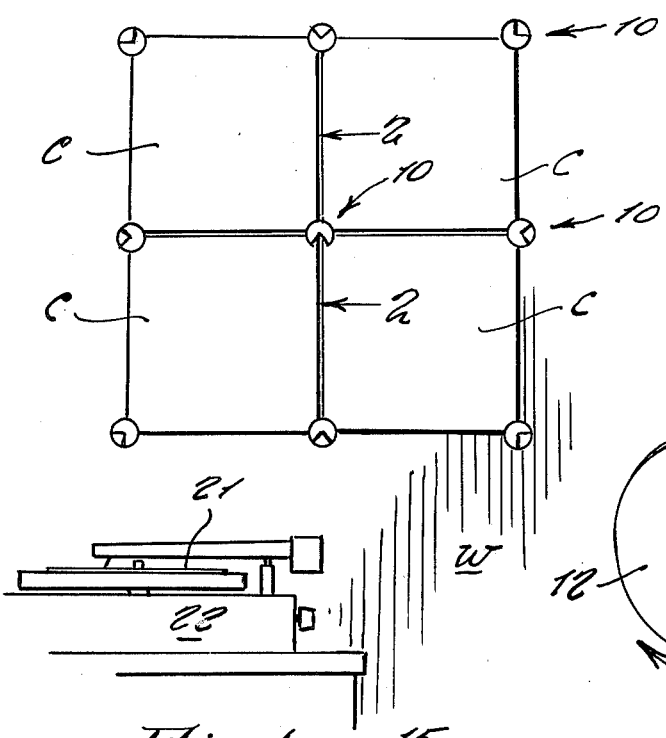
FIG. 1 is a view of a room wall, showing displayed record albums or covers, by means of the present invention holder.

It is readily evident, that a single holder can thus support a corner of four different covers at a common junction, thus allowing the covers to be displayed closely adjacent to each other, as shown in FIG. 1, if so desired.

The displayed covers can serve for storing the phonograph records therewithin, if so wished, thus providing a quick method to find a record 21, for placement upon the record player 22.

It is to be noted, that the adhesive on the rear of the holder does not, in any way, deface a wall, if removed therefrom.

In FIG. 7, a modified design of the invention is shown, wherein the base 23 has only a T-shaped rib 24, instead of the above-described crossing ribs, so that it can hold a double album lying flat in the full width space 25.

In FIG. 8, a single straight rib 26, on the base 27, produces two full width spaces 25, in order to hold two double albums therein.

In FIG. 9, still another modified design of the invention includes a base assembly 28, which is fully adjustable, so as to have either the above-described crossing ribs, T-shaped rib, or a single straight rib, as wished, so as to suit the covers or albums, as needed. In this design, there is a circular base 29, with crossing rows of holes 30, the rows being at right angles to each other. Separate ribs 31, of short length, molded of hard plastic, each includes a pair of posts 32, for fitting in the holes 30. Thus, one or four such ribs may be attached, as needed.

The design in FIG. 9 also shows an enlarged, split head 33 on the end of disc stem 34, so as to snap fit into enlarged rear portion disc rotation without falling off.

A detent 37 and recess 38, on a rib, may be included, so as to hold a disc from rotating when holding a cover.

While the present invention is not limited to specific sizes, a practical diameter for the holder would be about two inches.

While various changes may be made in the detail construction, it is understood that such changes will be within the spirit and scope of the present invention, as is defined by the appended claims.

What I now claim is:

1. A phonograph record cover holder, comprising, in combination, a base and a disc molded of rigid plastic; said base comprising a circular member having a hole therethrough and pressure-sensitive adhesive on its rear side, and a rib means on its front side, said disc comprising a circular member having a rearward stem at the center of its rear side, said stem rotatably fitting in said hole through the center of said base, a rear side of said disc abutting against said rib means, said rib means forming spaces between said base and disc, for receiving phonograph cover corners, and said disc having a one-quarter notch on its periphery for said cover corner to pass therethrough.

2. The combination as set forth in claim 1, wherein said rib means comprises a plurality of separate rib members having posts on their rear sides, said base having additional holes for receiving said posts.

3. The combination as set forth in claim 2, wherein said stem includes an enlarged split head on the end thereof which snap fits in an enlarged rear end of said base central hole.

* * * * *